US011517810B2

(12) United States Patent
Clark, III et al.

(10) Patent No.: US 11,517,810 B2
(45) Date of Patent: Dec. 6, 2022

(54) ARROW GOLF APPARATUS AND METHOD

(71) Applicants: Woodrow W Clark, III, Morro Bay, CA (US); Jeffrey Smith, Irvine, CA (US)

(72) Inventors: Woodrow W Clark, III, Morro Bay, CA (US); Jeffrey Smith, Irvine, CA (US)

( * ) Notice: Subject to any disclaimer, the term of this patent is extended or adjusted under 35 U.S.C. 154(b) by 201 days.

(21) Appl. No.: 17/112,032

(22) Filed: Dec. 4, 2020

(65) Prior Publication Data

US 2022/0176234 A1 Jun. 9, 2022

(51) Int. Cl.
*A63F 9/02* (2006.01)

(52) U.S. Cl.
CPC ..... *A63F 9/0252* (2013.01); *A63F 9/0243* (2013.01); *A63F 2009/0269* (2013.01)

(58) Field of Classification Search
CPC ..... A63F 9/0252; A63F 9/0243; A63F 2009/0269
USPC ..... 273/348; 473/173, 197
See application file for complete search history.

(56) References Cited

U.S. PATENT DOCUMENTS

| | | | | |
|---|---|---|---|---|
| 6,083,114 | A * | 7/2000 | Bailey | A63B 57/357 473/196 |
| 6,569,028 | B1 * | 5/2003 | Nichols | A63B 69/3694 473/153 |
| 8,505,524 | B2 * | 8/2013 | Lyon | F41B 5/14 473/409 |
| 9,441,926 | B1 * | 9/2016 | Bond | F42B 6/08 |
| 2017/0001088 | A1 * | 1/2017 | Bond | A63B 67/02 |
| 2020/0248992 | A1 * | 8/2020 | Poole | F41J 11/00 |

* cited by examiner

*Primary Examiner* — Allen Chan
(74) *Attorney, Agent, or Firm* — Donald R. Boys; Central Coast Patent Agency LLC

(57) ABSTRACT

An arrow golf system has a bow having a bowstring, an arrow having a shaft with a ball on one end with a fletching and a string nock on an opposite end, a starting location, a finishing location, and a capturing apparatus at the finishing location. A player shoots the arrow from the starting location with the bow, to a second location closer to the finishing location, retrieves the arrow at the second location, and shoots the arrow toward the capturing apparatus from the second location.

20 Claims, 7 Drawing Sheets

ARROW GOLF APPARATUS AND METHOD

BACKGROUND OF THE INVENTION

1. Field of the Invention

The instant invention is in the technical area of apparatus and methods for sort and pertains more particularly to a sport of golf played with arrows and a crossbow.

2. Description of Related Art

Arrow golf games are known in the conventional art to some extent, and two such are listed in an Information Disclosure Statement filed with this patent application. The applicant has reviewed the references cited and believes that there are many unmet needs and patentable distinctions that are addressed in enabling detail in the instant patent application.

What is clearly needed is a golf sport played with golf balls implemented on arrows that may be propelled by a crossbow, and that also has a target skill component.

BRIEF SUMMARY OF THE INVENTION

In one embodiment of the invention an arrow golf system is provided, comprising a bow having a bowstring, an arrow having a shaft with a ball on one end with a fletching and a string nock on an opposite end, a starting location, a finishing location, and a capturing apparatus at the finishing location. A player shoots the arrow from the starting location with the bow, to a second location closer to the finishing location, retrieves the arrow at the second location, and shoots the arrow toward the capturing apparatus from the second location.

In one embodiment the player shoots the arrow from the second location to a third location after shooting the arrow to the second location and shoots the arrow toward the capturing apparatus from the third location. Also, in one embodiment the system further comprises a scoring protocol based on number of times arrow is shot before being captured in the capturing apparatus. In one embodiment the bow is a pistol-type crossbow. And in one embodiment the capturing apparatus comprises a net carried on a support at the finishing location.

In one embodiment of the system the support is a vertically oriented net stick at the finishing location, with the net attached to the net stick at a point above ground level. Also, in one embodiment the capturing apparatus comprises a plurality of nets arranged around the net stick, each net having a unique shape and size, differing from other nets of the capturing apparatus. Also, in one embodiment the bow is a pistol-type crossbow. In one embodiment the system further comprises two arrows, a first of which is a driver arrow and a second of which is a putter arrow, the driver arrow ball being smaller in diameter than the putter arrow ball. And in one embodiment the driver arrow and the putter arrow further comprise weighting elements adapted to influence trajectory and momentum of the arrows in flight.

In one embodiment the system further comprises a plurality sets of starting areas, finishing areas, capturing apparatus and fairways, as in a golf course, wherein players compile scores for individual ones of the sets, adding to an overall score for all the sets. Also, in one embodiment the net system further comprises attachment apparatus whereby the nets are attached to the net stick in a manner that the nets may be raised, lowered, rotated around the net stick, or removed. Also, in one embodiment the nets differ by color, each color associated with a different score. And in one embodiment the nets are illuminated.

In another aspect of the invention a method for arrow golf is provided, comprising shooting an arrow having a shaft with a ball on one end and a fletching and a string nock on an opposite end with a bow having a bowstring, from a starting location along a fairway toward a finishing location, the arrow landing at a second location, and retrieving the arrow from the second location and shooting the arrow toward a capturing apparatus at the finishing location from the second location.

In one embodiment the method further comprises shooting the arrow from the second location to a third location after shooting the arrow to the second location and shooting the arrow toward the capturing apparatus from the third location. In one embodiment the method further comprises a scoring protocol based on number of times arrow is shot before being captured in the capturing apparatus. Also, in one embodiment the bow is a pistol-type crossbow, and the method comprises shooting the arrow with the crossbow. In one embodiment the capturing apparatus is a net carried on a support at the finishing location, and the method comprises shooting the arrow into the net of the capturing apparatus. And in one embodiment the support is a vertically-oriented net stick at the finishing location, with the net attached to the net stick at a point above ground level, and the method comprises shooting the arrow into the net attached to the net stick.

In one embodiment of the method the capturing apparatus comprises a plurality of nets arranged around the net stick, each net having a unique shape and size, differing from other nets of the capturing apparatus, the method comprising shooting the arrow at a specific one of the plurality of nets. Also, in one embodiment the bow is a pistol-type crossbow, and the method comprises shooting the arrow with the crossbow. In one embodiment there are two arrows, a first of which is a driver arrow and a second of which is a putter arrow, the driver arrow ball being smaller in diameter than the putter arrow ball, the method comprising shooting the driver arrow in approaches to the finishing location, and shooting the putter arrow into the capturing mechanism.

In one embodiment the driver arrow and the putter arrow further comprise weighting elements adapted to influence trajectory and momentum of the arrows in flight, the method comprising shooting the driver arrow in approaches to the finishing location, and shooting the putter arrow into the capturing mechanism. In one embodiment there is a plurality of sets of starting areas, finishing areas, capturing apparatus and fairways, as in a golf course, wherein players compile scores for individual ones of the sets, adding to an overall score for all the sets. And in one embodiment the capturing apparatus further comprises an attachment device whereby the nets are attached to the net stick in a manner that the nets may be raised, lowered, rotated around the net stick, or removed.

DETAILED DESCRIPTION OF THE INVENTION

Figure 1:
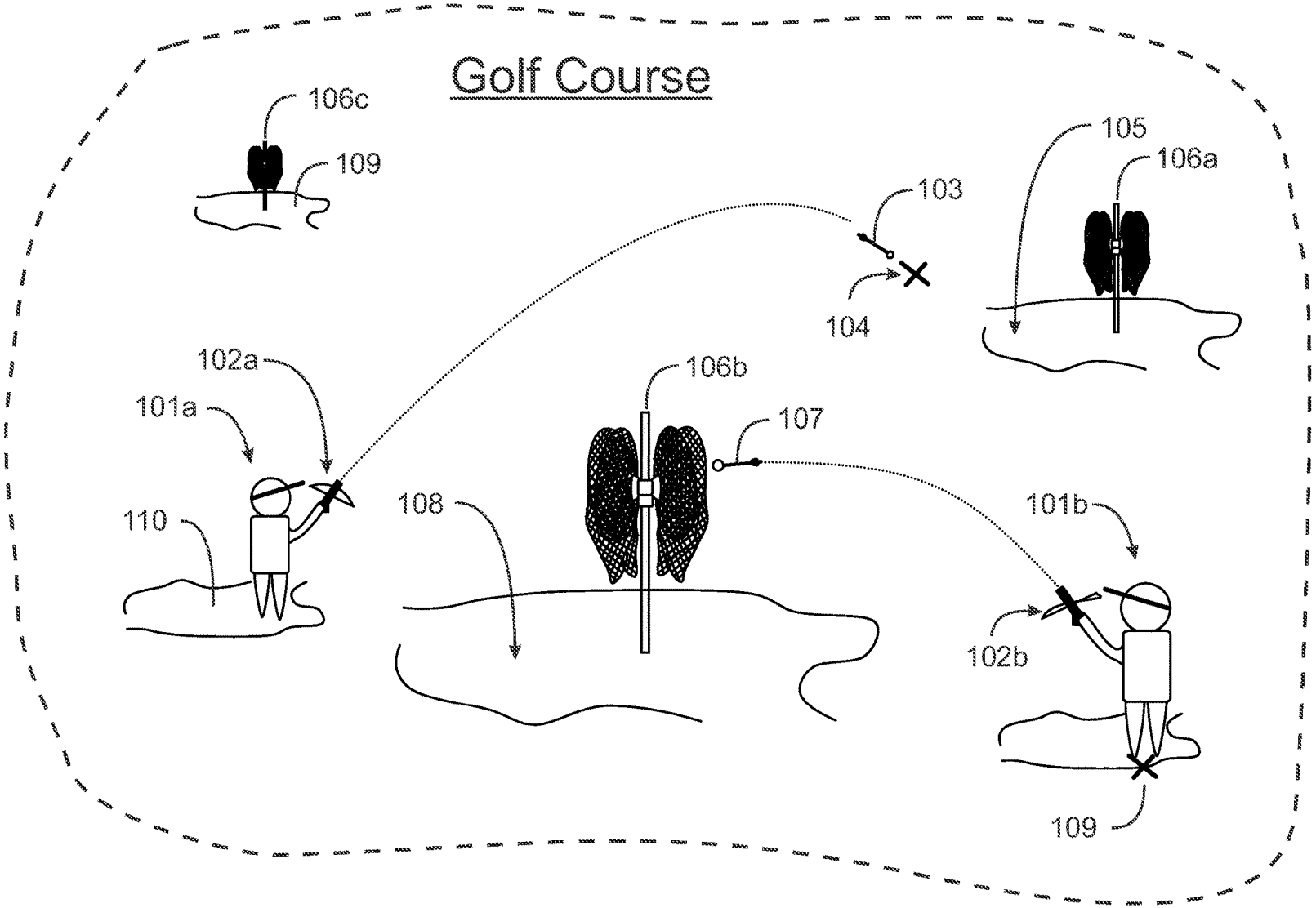
FIG. 1 is an elevation view of a golf course and greens in an embodiment of the present invention.

FIG. 1 is an elevation view of a golf course with greens 105, 108 and 109 in an embodiment of the present invention. There may be more greens, as many as on a conventional golf course (usually eighteen), or fewer, such as just one. Each green in this example has a unique capturing apparatus, being apparatus 106*a* for green 105, apparatus 106*b* for green 108, and apparatus 106*c* for green 109. In one embodiment each capturing apparatus comprises a net system having a net stick, and a plurality of nets surrounding the net stick at a certain height above the green. Individual ones of the nets may be of a different color in one embodiment. The net system according to embodiments of this invention is described in further enabling detail below.

In FIG. 1 a first player 101*a* is illustrated shooting an arrow 103 from a starting location 110 associated with green 105 using a pistol-type crossbow 102*a* which follows a trajectory and lands at a second location 104 proximate green 105, along a fairway between the starting location and the finishing location, which is the green. Arrow 103 is a Driver Arrow in this example and is described in more enabling detail below. A second player 101*b* is illustrated standing at a point 109, proximate green 108, and has launched an arrow 107 using pistol crossbow 102*b* which may be the same as crossbow 102*a*.

Arrow 107 is termed a Putter Arrow, and is different than arrow 103, as is also described in enabling detail below. The launching of the putter arrow to capturing apparatus 106*b* requires aiming skill to place the Putter Arrow in a particular one of several nets arranged circumferentially around the net stick of capturing apparatus 106*b*. In one embodiment of the invention there may be four nets of different colors, each net representing a different score. As in conventional golf, the lowest score at the end wins, so the player is motivated to shoot the Putter Arrow into the net of the color that represent the lowest score. The net for the lowest score, say one, represents a made first put.

In a golf game according to an embodiment of the present invention there may be a plurality of greens, as in a conventional golf game. In one embodiment as many as eighteen. A player starts at a starting location for green one and launches a Driver Arrow using the crossbow. It is to be noted that there is a further advantage to using a pistol-type crossbow, in that a user can manipulate the crossbow in ways to influence the flight of an arrow, that may not be available in use of conventional bows or crossbows. For example, a user may move the crossbow in an arc when shooting the arrow and influence the arrows flight in doing so. This adds a level of skill to the launching of the arrow. However it is to be noted that in some embodiments the crossbow is not used, but a simpler conventional bow.

The player, after launching the Driver Arrow, walks to where a second location where the Driver Arrow launched from the starting location lands, and if that point is not close enough for a good shot at the capturing apparatus of green 1, standing at that landing spot, at her turn, launches the Driver Arrow again toward green 1, trying for a closer approach to the capturing apparatus of green one (see point 104 in FIG. 1).

If the first drive or a subsequent approach shot is judged by the player to be close enough for a good shot at the capturing apparatus of the green the player may elect to use the crossbow with a Putter Arrow to try to place the Putter Arrow in one of the nets of the capturing apparatus. This circumstance is shown by player 101*b* at point 109 in FIG. 1, launching Putter arrow 107*m* toward capturing apparatus 106*b*. The player takes a point for each tee shot and approach shot, and a point for each putter shot that misses. The player also takes points for the assigned point value of the net of the net system. Low score wins as in conventional golf.

After playing a first green (hole), the player tees off again with her Driver arrow at a second starting location for a second green, and plays the second green following the same rules, judgement and scoring as the first green.

In one embodiment of the invention there may be just one course and green, and several players may contend with one another in a game over that one green. This circumstance may be one in which a player sets up a single course at any chosen location and elects to play with friends, for example.

In one embodiment there may be a course set more permanently where players may come and play with their own bows (meeting game standards), and there may be a series of greens. Players in such a circumstance may keep scorecards as in conventional golf, and low score at end of all greens is a winning score. There may be tournaments, and playoffs for ties as in conventional golf.

Figure 2:
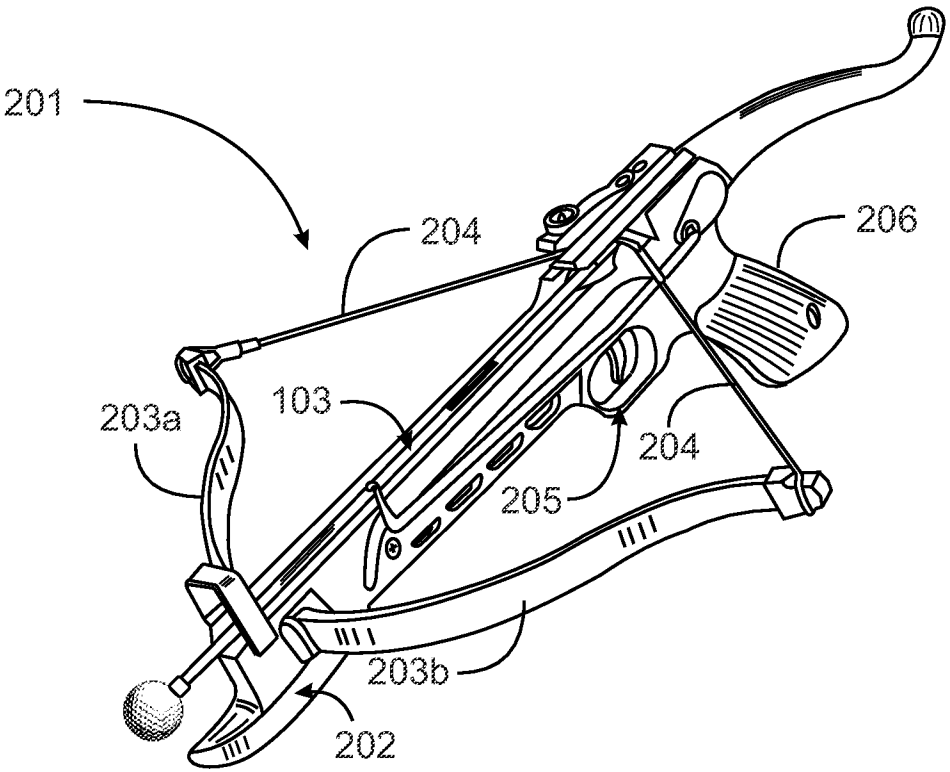
FIG. 2 is a perspective view of a pistol-type crossbow that may be used in golf games according to embodiments of the present invention.

FIG. 2 is a perspective view of a pistol-type crossbow 201 that may be used in golf games according to embodiments of the present invention. Crossbow 201 in one embodiment is a commercially available mini crossbow from Southland Archery Supply. This is not a limitation in the invention, as other pistol-type crossbows, or even full-size crossbows may be used in different embodiment.

Crossbow 201 has a body frame 202 with bow springs 203*a* and 203*b* attached. Bowstring 204 is joined to the ends of the bow springs, and drawn back into a trigger mechanism, which may be released bi trigger apparatus 205. The crossbow is held in one hand by a pistol grip 206. A Drive Arrow 103 is shown loaded and notched, ready to be fired from the crossbow.

Figure 3A:
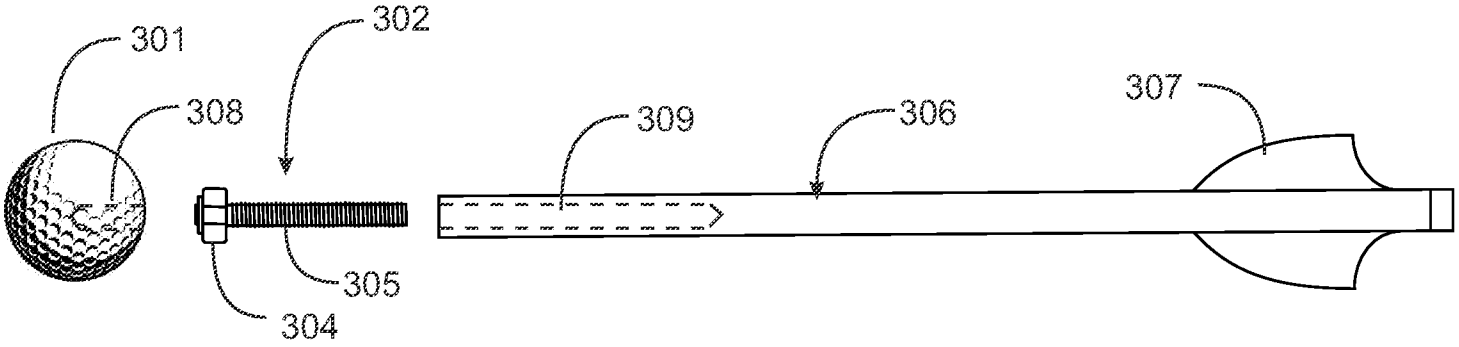
FIG. 3A is an exploded view of a Driver Arrow 103 in an embodiment of the invention.

FIG. 3A is an exploded view of Drive Arrow 103, comprising a foam ball 301 formed, in this example, to look like a golf ball, and of the size of a regulation golf ball. A threaded rod 305 with a threaded nut 304 and an arrow shaft 306. The size of the ball is not a limitation to the scope of the invention. Shaft 306 has fletching 307 attached, and in this example has a hole 309 from the ball end of a diameter to accept threaded rod 305. Ball 301 may also have a hole 308 for a depth, also of a diameter to accept the threaded rod. In one embodiment the holes 308 and 309 may be threaded to match the thread of the threaded rod.

Figure 3B:
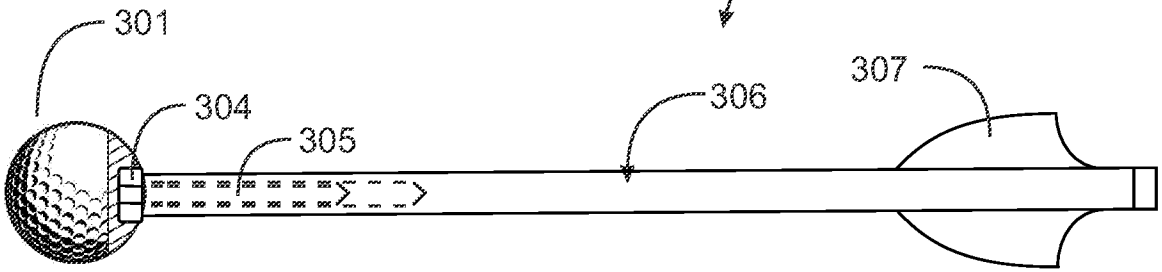
FIG. 3B shows the Drive Arrow of FIG. 3A assembled.

FIG. 3B shows the elements of FIG. 3A assembled, with threaded rod 305 inserted into both the arrow shaft and the ball, with the nut turned to tighten the threaded rod to the arrow shaft. The threaded rod and the nut together form a weight of quantity to facilitate flight of the assembled Driver Arrow. In FIG. 3A a portion of ball 301 is shown cut away to illustrate that nut 304 in assembly is actually inside a portion of ball 301. In one instance the assembly is with adhesive. In another the threaded rod may engage the ball. In another, both may be used. The shaft length may be altered to alter the weight, which may be determined by experiment.

It is not required that the ball be foam, as it may in alternative embodiments be of other materials. And in some embodiments the ball may be weighted as well as, or rather than the shaft.

Figure 4A:
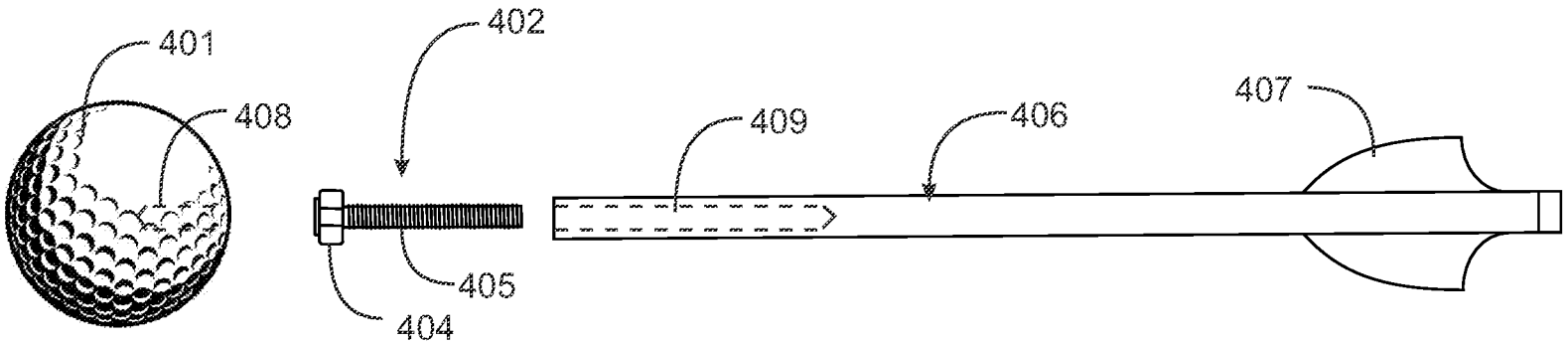
FIG. 4A is an exploded view of a Putter Arrow in an embodiment of the invention.

FIG. 4A is an exploded view of Putter Arrow 107, comprising a foam ball 401 formed, in this example, to look like a golf ball, but which may be substantially larger in diameter than a conventional golf ball, and in this example is also substantially larger in diameter than ball 103 of the Driver Arrow of FIGS. 3A and 3B. There is a threaded rod 405 with a threaded nut 404 and an arrow shaft 406. Shaft 406 has fletching 407 attached, and in this example has a hole 409 from the ball end of a diameter to accept threaded rod 405. Ball 401 may also have a hole 408 for a depth, also of a diameter to accept the threaded rod. In one embodiment the holes 408 and 409 may be threaded to match the thread of the threaded rod.

Figure 4B:
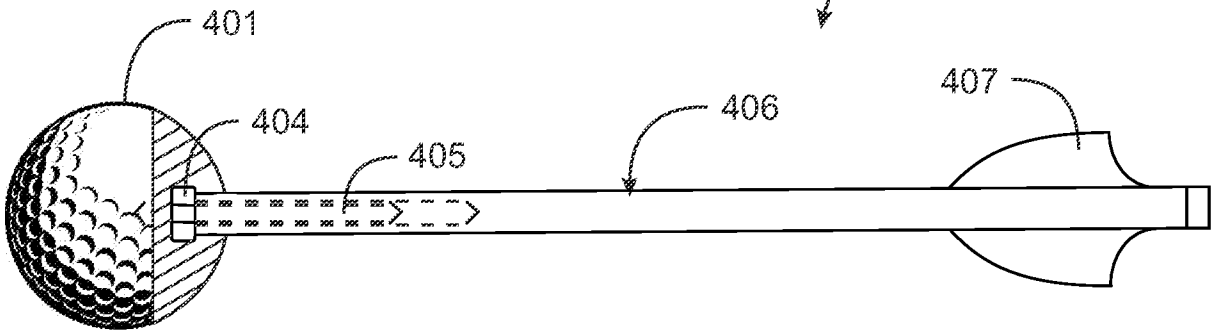

FIG. 4B shows Putter Arrow 107 assembled. In FIG. 4B a portion of ball 401 is shown cut away to illustrate that nut 404 in assembly is actually inside a portion of ball 401. In one instance the assembly is with adhesive. In another the threaded rod may engage the ball. In another, both may be used. It is not required that ball 401 be foam, as it may in alternative embodiments be of other materials. And in some embodiments the ball may be weighted as well as, or rather than the shaft.

Figure 5A:
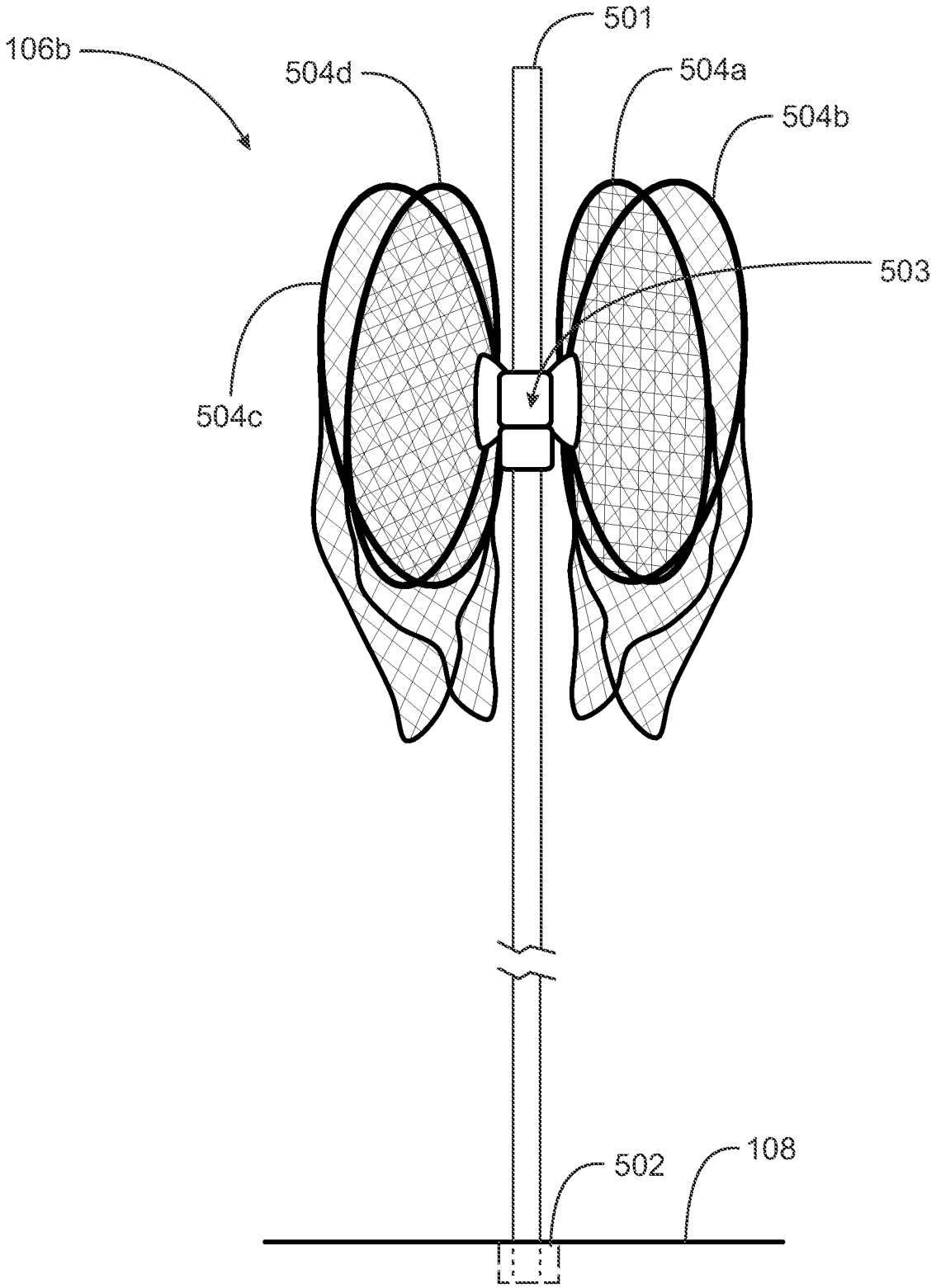
FIG. 5 is an elevation view of a capturing apparatus at a finishing location in an embodiment of the invention.

FIG. 5A is an elevation view of capturing apparatus 106*b* at green 108 from FIG. 1. It should be noted that each green may have its own capturing apparatus, but the apparatus may be identical, or may vary from green to green. In embodiments of the invention the capturing apparatus may be elevated on a support, the support may be a net stick, and there may be nets attached to net stick to capture arrows. Net system 106*b* is based on a net stick 501, which may be the same as a conventional flag stick at a hole in a green on a conventional golf course.

Net stick 501 in FIG. 5A is shown in broken view to be able to show some elements larger. Net stick 501 may be in one embodiment the flag stick used on a conventional golf course. Net stick 501 is shown in a cup 502 in green 108. Net system 106*b* does not have a conventional flag on the stick, but does have a plurality of nets, in this example four, being nets 514*a*, 504*b*, 504*c* and 504*d*. The four nets in this example engage a removable, adjustable mounting assembly 503 that is described in further enabling detail below. Mounting assembly 503 may be loosened to be moved higher or lower on the net stick, and may be removed altogether, removing the nets.

Figure 5B:
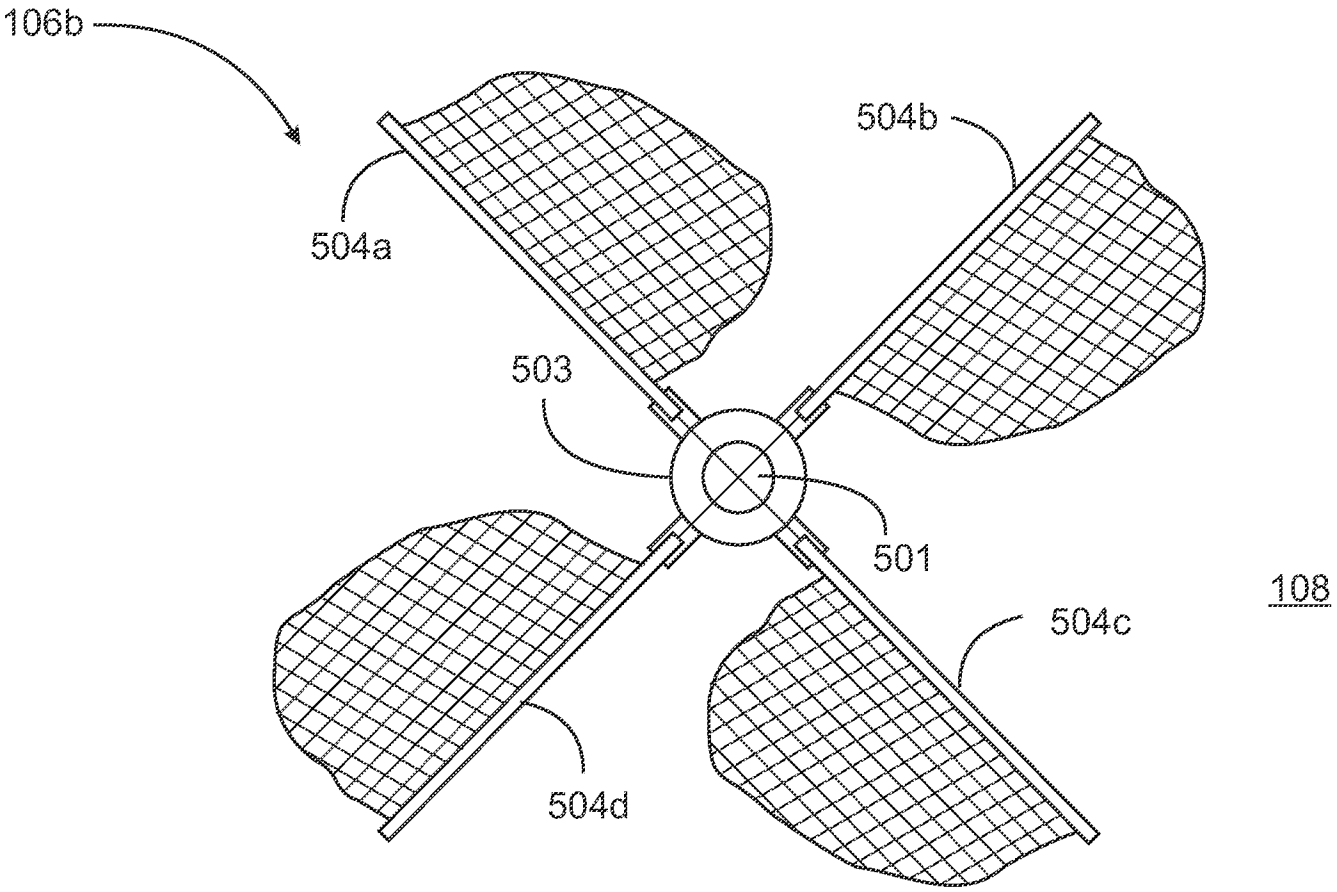

FIG. 5B is a plan view of net system 106*b* showing net stick 501, mounting assembly 503 and nets 504*a*, 504*b*, 504*c* and 504*d* over green 108. Boundaries of green 108 are not shown in FIG. 5B as a matter of scale. In this example the nets are arrayed from the net stick in ninety-degree increments. In one embodiment the mounting assembly is adapted in a manner that the nets may be collapsed into a single plane to be compact for movement and storage. Also, in one embodiment the nets may be of different colors, and a color may be associated with a score, requiring shooting skill by a player to select a low score net and to shoot the Putter Arrow into the net selected. In some embodiments the diameter and/or shape of the hoops may vary for the nets of different colors. In one embodiment of the invention there are four nets, one of which is red, and sixteen inches in diameter, two of which are yellow, and are both fourteen inches in diameter, and one of which is green, and is twelve inches in diameter. The green net is associated with the lowest score, which may be one, the yellow with a next lowest score, which may be two, and the red with the highest score which may be three.

In one embodiment rims of the nets may have light-emitting diodes which may be lit, and the diodes may be in the color of the net. Nets and rims may be illuminated in other ways as well. For example, in one embodiment there may be a lighting module adapted to engage the net stick, and the lighting module may have lighting elements in different colors focused on individual ones of the nets. In addition balls and arrows may also be illuminated in a variety of ways.

Figure 6:
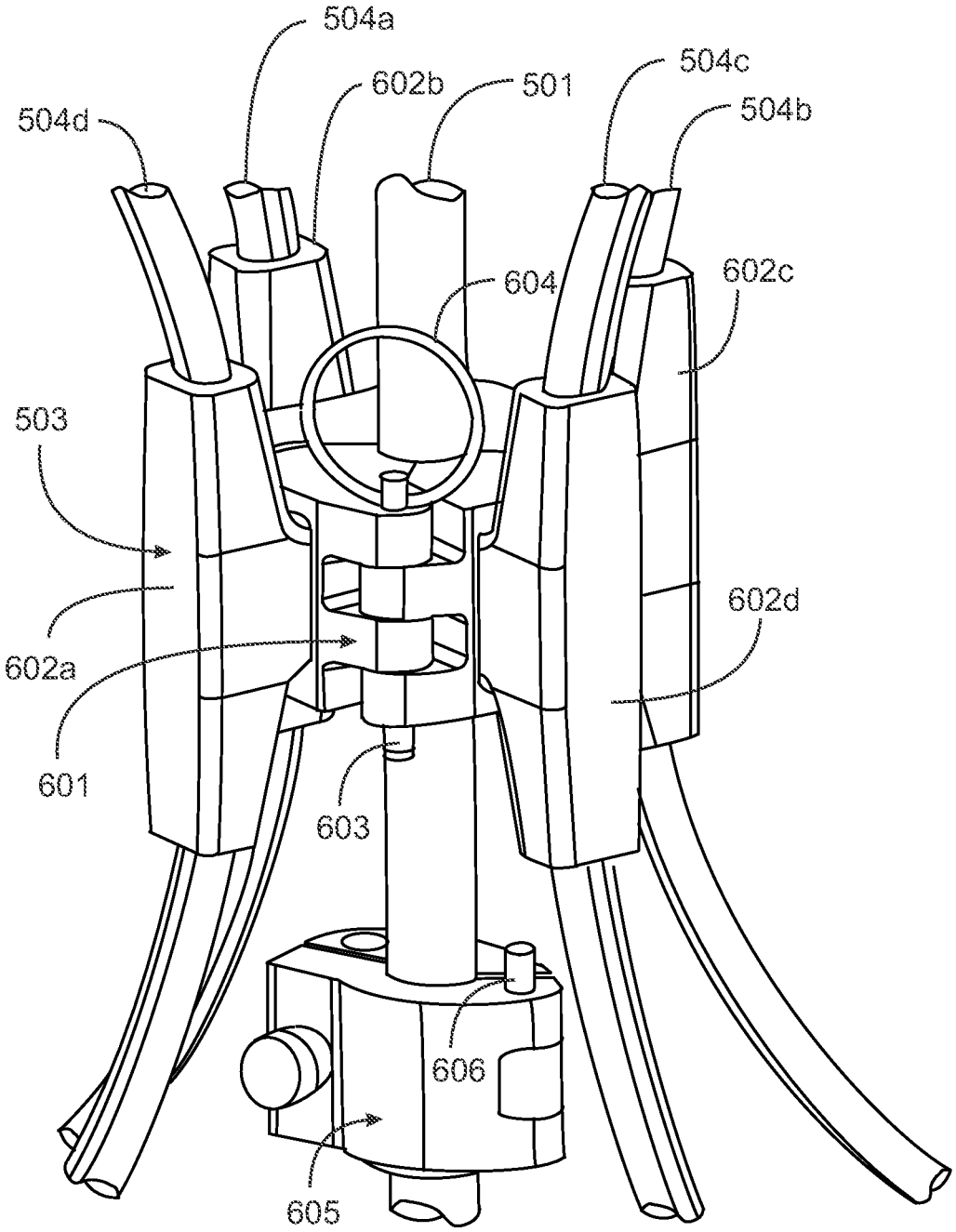
FIG. 6 is an elevation view of a mounting assembly in one embodiment of the invention, for mounting nets to a net stick.

FIG. 6 is an elevation view of mounting assembly 503 in one embodiment of the invention. Although not shown explicitly in FIGS. 5A and 5B due to scale, there are several parts to assembly 503 as seen in FIG. 6. A hinged clamp element 605 serves as a base for assembly 503. Clamp element 605 may be opened and placed around net stick 501 at a desired height, then closed and clamped to the net stick. An upper mounting assembly 601 is also hinged and may be opened and placed around the net stick above clamp element 605. Mounting assembly 601 is held closed by a pin 603 passing through vertical holes in wings of mounting assembly 601. Pin 603 is joined to a ring 604, such that the pin may be pulled to open the mounting assembly. Upper mounting assembly 601 slides down the net stick when mounted and rests on clamp element 605 and is constrained to a certain radial position by a pin 606 which engages a hole in mounting assembly 601. Clamp 605 can also be mounted with pin 606 facing downward to allow element 605 to spin freely for an alternate form of play. In one embodiment of the invention assembly 503 may be free to rotate on the net stick, supported by clamp 605. In this embodiment when a user shoots a Putter Arrow into one of the nets, the net assembly may rotate.

Upper mounting assembly 601 has, in this example, four extensions 602A, 602*b*, 602*c* and 602*d*, that engage nets 504*a*, 504*b*, 504*c* and 504*d*.

In the example shown in FIG. 6 the height of the nets on the net stick may be adjusted by manipulating clamp element 605. The orientation of the nests may be changed by lifting the upper assembly from the clamp element and rotating the upper mounting assembly. The nets may be removed by pulling pin 604 and opening and removing mounting assembly 601.

A skilled person will understand that the embodiments illustrated and described in this application are entirely exemplary and are not limiting to the scope of the invention. There are a variety of ways that assemblies and elements may be accomplished that differ from the examples illustrated and described, but that still fall within the scope of the invention. For example, there are embodiments of the invention wherein net systems as described may be mounted to other than net sticks or flag sticks at a green on a golf course. In some embodiments of a game using the apparatus described net systems may be mounted on such as a disc golf goal, a picnic table a free standing base of just about any sort, or just about any support that is convenient to hold a net system.

In embodiments of the invention the rules of the game are arbitrary in many cases, and it is not necessary that a Driver arrow land at or near a green, or other net system support, for a player to switch to the Putter Arrow.

Further to the above, in the elements and assembly of both the Driver arrow and the Putter arrow in many embodiments of the invention the threaded rod serves as a weight to provide momentum and trajectory for the arrow. The effect of the added weight may be adjusted and varied by altering the length of the threaded rod, and by altering the position of the threaded rod relative to the arrow shaft. Other elements may be used for the same purpose, such as any relatively heavy cylindrical object.

In some embodiments a nut such as nuts 304 and 404 may not be used at all, and the position of a weight may be secured in other ways.

The scope of the invention is limited only by the claims.

The invention claimed is:

1. An arrow golf system, comprising;

a bow having a bowstring;

an arrow having a shaft with a ball on one end with a fletching and a string nock on an opposite end;

a starting location;

a finishing location; and a capturing apparatus at the finishing location, the capturing apparatus comprising a net adapted to capture the arrow having a shaft with a ball on one end, the net comprising net material affixed to a vertically oriented hoop elevated on a vertical net stick extending from a ground surface;

wherein a player shoots the arrow from the starting location with the bow, to a second location closer to the finishing location, retrieves the arrow at the second location, and shoots the arrow toward the capturing apparatus from the second location.

2. The system of claim 1 wherein the player shoots the arrow from the second location to a third location after shooting the arrow to the second location and shoots the arrow toward the capturing apparatus from the third location.

3. The system of claim 2 further comprising a scoring protocol based on a number of times an arrow is shot before being captured in the capturing apparatus.

4. The system of claim 1 wherein the bow is a pistol-type crossbow.

5. The system of claim 1 wherein the capturing apparatus comprises a plurality of nets arranged around the net stick, each net having a unique shape and size, differing from other nets of the capturing apparatus.

6. The system of claim 1 comprising two arrows, a first of which is a driver arrow and a second of which is a putter arrow, the driver arrow ball being smaller in diameter than the putter arrow ball.

7. The system of claim 6 wherein the driver arrow and the putter arrow further comprise weighting elements adapted to influence trajectory and momentum of the arrows in flight.

8. The system of claim 1 further comprising a plurality of sets of starting areas, finishing areas, capturing apparatus and fairways, as in a golf course, wherein players compile scores for individual ones of the sets, adding to an overall score for all the sets.

9. The system of claim 5 wherein the net system further comprises attachment apparatus whereby the nets are attached to the net stick in a manner that the nets may be raised, lowered, rotated around the net stick, or removed.

10. The system of claim 5 wherein the nets differ by color, each color associated with a different score.

11. The system of claim 5 wherein the nets are illuminated.

12. A method for arrow golf, comprising;

shooting an arrow having a shaft with a ball on one end and a fletching and a string nock on an opposite end with a bow having a bowstring, from a starting location along a fairway toward a finishing location, the arrow landing at a second location; and retrieving the arrow from the second location and shooting the arrow toward a capturing apparatus at the finishing location from the second location, the capturing apparatus comprising a net adapted to capture the arrow having a shaft with a ball on one end, the net comprising net material affixed to a vertically oriented hoop elevated on a vertical net stick extending from a ground surface.

13. The method of claim 12 comprising shooting the arrow from the second location to a third location after shooting the arrow to the second location and shooting the arrow toward the capturing apparatus from the third location.

14. The method of claim 13 further comprising a scoring protocol based on a number of times an arrow is shot before being captured in the capturing apparatus.

15. The method of claim 12 wherein the bow is a pistol-type crossbow, comprising shooting the arrow with the crossbow.

16. The method of claim 12 wherein the capturing apparatus comprises a plurality of nets arranged around the net stick, each net having a unique shape and size, differing from other nets of the capturing apparatus, the method comprising shooting the arrow at a specific one of the plurality of nets.

17. The method of claim 12 comprising two arrows, a first of which is a driver arrow and a second of which is a putter arrow, the driver arrow ball being smaller in diameter than the putter arrow ball, the method comprising shooting the driver arrow in approaches to the finishing location, and shooting the putter arrow into the capturing mechanism.

18. The method of claim 17 wherein the driver arrow and the putter arrow further comprise weighting elements adapted to influence trajectory and momentum of the arrows in flight, the method comprising shooting the driver arrow in approaches to the finishing location, and shooting the putter arrow into the capturing mechanism.

19. The method of claim 12 further comprising a plurality of sets of starting areas, finishing areas, capturing apparatus and fairways, as in a golf course, wherein players compile scores for individual ones of the sets, adding to an overall score for all the sets.

20. The method of claim 16 wherein the capturing apparatus further comprises an attachment device whereby the nets are attached to the net stick in a manner that the nets may be raised, lowered, rotated around the net stick, or removed.

* * * * *